United States Patent [19]

Raihala

[11] Patent Number: 4,479,483

[45] Date of Patent: Oct. 30, 1984

[54] SAFETY STOVEPIPE DAMPER ASSEMBLY

[76] Inventor: Kenneth H. Raihala, 2316 Wyoming Ave., Superior, Wis. 54880

[21] Appl. No.: 488,653

[22] Filed: Apr. 26, 1983

[51] Int. Cl.[3] ..... F23L 3/00

[52] U.S. Cl. ..... 126/292; 126/293; 126/285 R; 236/90; 236/96

[58] Field of Search ..... 126/285 R, 285.5, 292, 126/295, 290, 307 R, 307 A, 312; 236/90, 96, 93 R, 45, 101 D, 1 G; 431/20

[56] References Cited

U.S. PATENT DOCUMENTS

| | | | |
|---|---|---|---|
| 2,358,390 | 9/1944 | Field, Jr. | 236/45 |
| 2,454,044 | 11/1948 | Eggert | 236/96 |
| 4,165,833 | 8/1979 | Nagel | 431/20 |
| 4,236,668 | 12/1980 | Prikkel | 236/1 G |

*Primary Examiner*—James C. Yeung

[57] ABSTRACT

A safety stovepipe damper assembly designed for use with a conventional type stovepipe and damper as used on coal, wood, or waste burning stoves. Provisions are made for presetting the damper to a specific low fire or closed position. A latch is also provided to hold the damper at an open position when desired. A heat activated means of releasing the damper from an open damper position is contained within the safety assembly. When activated by abnormally high stovepipe temperatures, the damper returns by gravity to its preset or closed position. The safety assembly can be used on vertically or horizontally installed stovepipe and damper assemblies in all sizes.

7 Claims, 3 Drawing Figures

SAFETY STOVEPIPE DAMPER ASSEMBLY

This invention relates to stovepipe dampers and more specifically to a means of automatically returning an open damper to a predetermined or closed position when overheating of the stovepipe occurs.

Heretofore, stovepipe dampers which had been left in an open position during operation of the stove could result in overheating of the stove and stovepipe with possible danger of creating a chimney fire.

An object of the invention is to provide a safety damper for a stovepipe which having been preset to some closed dampered position will return the damper to that position from an open damper position when overheating of the stovepipe occurs.

Another object of the invention is to provide a safety damper assembly which can be installed onto an existing conventional type stovepipe and damper.

Yet another object of the invention is to provide a safety damper assembly for use on a conventional type stovepipe and damper installed in a vertical or horizontal position.

Yet another object of the invention is to provide a safety damper assembly for use on all sizes of conventional type stovepipes and dampers.

Yet a further object of the invention is to provide a safety damper assembly which is totally mechanical in operation.

A further object of the invention is to provide a safety damper assembly which can be conditioned to be inoperative when desired.

Other objects and advantages of the invention will be set forth or become apparent in the following drawings and description of a preferred embodiment of the invention.

Figure 1:
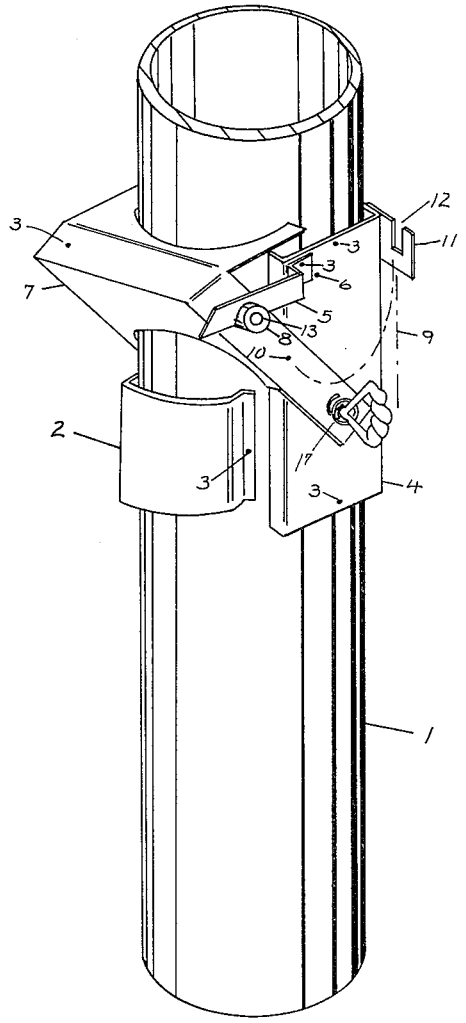
FIG. 1 is a perspective view of the invention showing the safety assembly mechanism installed onto a conventional stovepipe and damper assembly with the damper in an open position.
Figure 2:
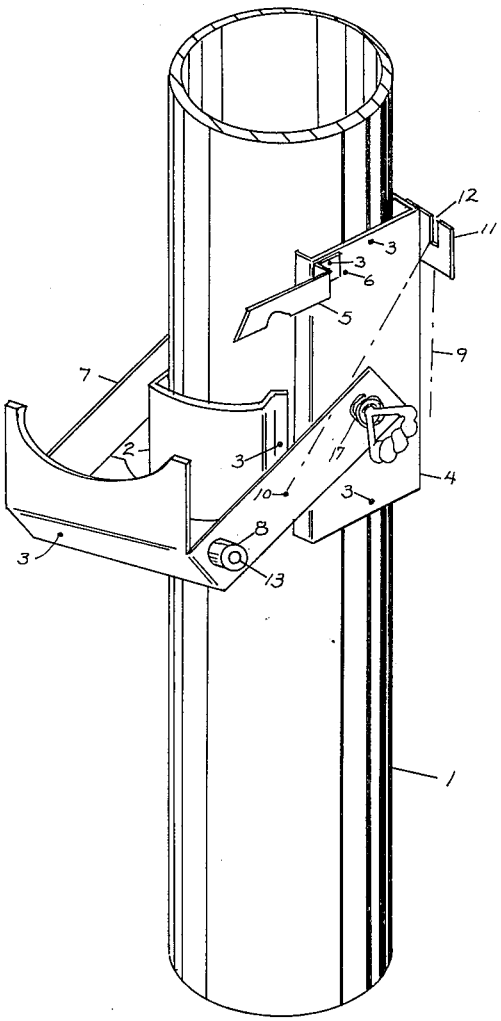
FIG. 2 is a perspective view of the invention showing the safety assembly mechanism installed onto a conventional stovepipe and damper assembly with the damper in a closed or dampered position.

Referring to FIG. 1 and FIG. 2 therein is shown a stovepipe 1 with conventional type damper 16 and damper shaft 15 to which the safety assembly mechanism is attached. The side plate 4 is shown affixed to the stovepipe 1 with fasteners 3. An aperture is provided in the side plate 4 through which a hole may be located in the stovepipe 1 for insertion of the damper shaft 15.

A clip 11 containing a narrow slot 12 is shown affixed to the upper end of the side plate 4 with fastener 3. A moveable latch 5 is also shown attached to the upper end of the side plate 4 by use of a fastener 3 allowing rotational movement about the fastener 3. The latch 5 contains a notch of suitable size and location to engage the knurled wheel 8 when the yoke 7 is in an open damper position. A stop 6 is provided on the side plate 4 for restricting excessive downward movement of the latch 5.

Figure 3:
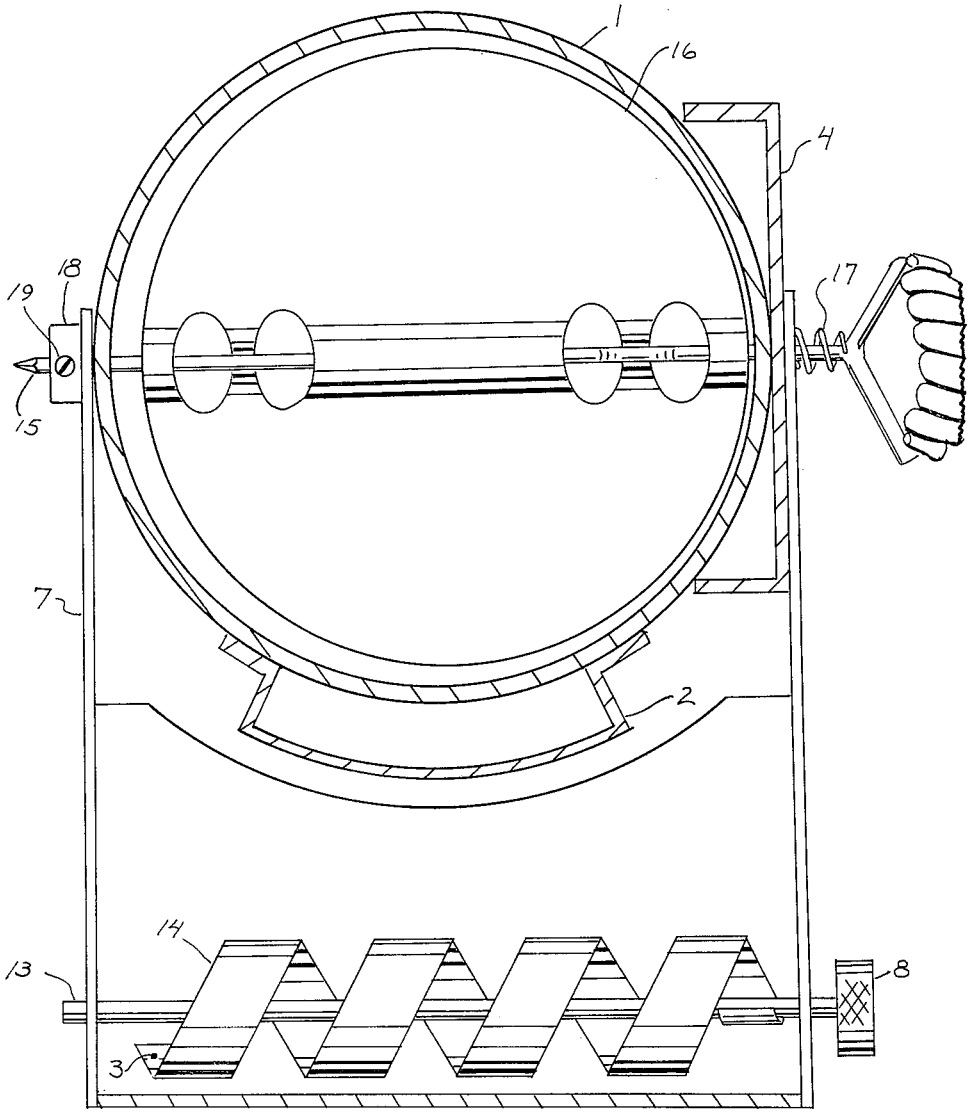
FIG. 3 is a cross-sectional view of the invention taken immediately above the damper shaft with the damper in a closed position.

Referring to FIG. 3 therein is shown a yoke 7 with contained bi-metal strip 14, shaft 13, and attached knurled wheel 8. The yoke 7 is positioned about the stovepipe 1 as shown. Apertures located at the ends of the yoke 7 are provided for insertion of the damper shaft 15. A set collar 18 with contained set screw 19 is affixed to one end of the yoke 7 concentric about the aperture provided. The set collar 18 attaches the yoke 7 securely to the damper shaft 15 and allows for disassembly and adjustment of the damper position.

A shaft 13 extends through holes provided at the base of the yoke 7. At one end of the shaft 13, a knurled wheel 8 is attached. The opposite end of the shaft 13 is attached to one end of the bi-metal strip 14. The other end of the spiral wound bi-metal strip 14 is secured to the yoke 7 by use of fastener 3. The bi-metal strip 14 is shown wound in the direction or hand to provide clockwise rotation of the knurled wheel 8 as viewed in FIG. 1 or FIG. 2 when the bi-metal strip 14 is heated.

Referring again to FIG. 1 or FIG. 2 therein is shown a length of beaded chain 9 attached at one end to the leg of yoke 7 with a swivel type anchor 10. The other end of the chain 9 is placed in the slot 12 of the clip 11. The slot 12 is sufficiently wide to accept the link of the bead chain 9 while not permitting the beads of the bead chain 9 to pass through.

A heat shield 2 is shown located on the stovepipe 1 in a position to reduce heat radiation form the stovepipe 1 to the bi-metal strip 14 contained on the yoke 7 when the yoke 7 is in a closed damper position as shown in FIG. 2. The heat shield 2 is attached to the stovepipe 1 with fasteners 3 and is designed to provide an air gap between the heat shield 2 and the stovepipe 1.

The safety stovepipe damper assembly contains therein several component parts which are of conventional design. These components include the stovepipe 1, damper 16, damper shaft 15, bead chain 9, fasteners 3, set collar 18, and set screw 19. These component parts and their application are well understood by those skilled in the art and therefore, the construction and operation of the aforementioned parts will not be discussed.

The side plate 4 of the safety stovepipe damper is formed from a heat-resistant material into a shallow channel configuration. This side plate 4 is provided with apertures to accommodate the damper shaft 15, latch 5, stop 6, and fasteners 3. The legs of the side plate 4 are of suitable length to allow contact with the stovepipe 1 when the lengthwise centerline of the side plate 4 is in contact with the stovepipe 1.

The clip 11 is attached to the upper end of the side plate 4 with its slot 12 as shown in FIG. 1 or FIG. 2. Also contained on the side plate 4 is the latch 5, provided with aperture about which it pivots and a notch which is designed to engage with the knurled wheel 8 as shown in FIG. 1. The latch 5 is of an offset design to align with the knurled wheel 8 contained on the yoke 7. A fastener 3 is used to attach the latch 5 to the side plate 4 while allowing for rotational movement about the fastener 3. A stop 6 is fastened to the side plate 4 and positioned to contact the latch 5, thus preventing rotational movement of the latch 5 to a position where engagement with the knurled wheel 8 could not be obtained.

The yoke 7 is of one piece construction designed to fit across a specific diameter stovepipe 1. Extensions at the base of the yoke 7 are designed to conform to the stovepipe 1 as shown in FIG. 1 forming an enclosure about the contained bi-metal strip 14. The legs of the yoke are provided with apertures through which the damper shaft 15 is positioned. A set collar 18 with contained set screw 19 is securely attached to one leg of the yoke 7 symmetrically about the aperture provided.

A shaft 13 extends through apertures provided at the base of the yoke 7. A knurled wheel 8 is attached to one end of the shaft 13. The shaft 13 is sufficiently long to allow alignment of the knurled wheel 8 with the latch 5 during assembly. A bi-metal strip 14 is attached at one end to the shaft 13 spiraled about the shaft 13 and secured to the yoke 7 with a fastener 3. The bi-metal strip 14 must be wound in such direction as to result in a rotation of the knurled wheel 8 which will lift latch 5, thus releasing the knurled wheel 8 when heat is applied to the bi-metal strip 14.

An anchor 10 is attached to one leg of the yoke 7. A length of beaded chain 9 is secured to the anchor 10 at one end and the opposite end inserted within the notch 12 of the clip 11.

A heat shield 2 shaped from a heat-resistant material is attached to the stovepipe 1 with fasteners 3. An air gap is formed between the heat shield 2 and the stovepipe 1 to reduce radiant heat from the stovepipe 1 to the bi-metal strip 14 when the yoke 7 is in a closed position as in FIG. 2.

Assembly of the safety stovepipe damper begins with the attachment of clip 11, stop 6, and latch 5 onto the side plate 4. Then, the side plate 4 is placed onto the stovepipe 1 and secured with fasteners 3. Utilizing the aperture provided on the side plate 4, apertures are located on a diameter of the stovepipe 1 perpendicular to the side plate 4 through which the damper shaft 15 will be inserted.

The yoke 7 is assembled with shaft 13, knurled wheel 8, and bi-metal strip 14. One end of the bi-metal strip 14 is secured to the shaft 13, while the opposite end of the bi-metal strip is secured to the yoke 7 by use of a fastener 3. A set collar 18 with set screw 19 is attached to one leg of the yoke.

The yoke 7 is then placed about the stovepipe 1 and the side plate 4 such that the holes in the extension of the yoke 7 and the stovepipe 1 are in alignment. The damper shaft 15 with spring 17 is inserted through the aligned apertures on the legs of the yoke 7, the side plate 4, and the stovepipe 1. The damper 16 is then placed within the stovepipe 1 and the damper shaft 15 is inserted through the damper 16 and through the apertures contained in the opposite wall of the stovepipe 1 and the leg of yoke 7 containing set collar 18. The damper 16 is secured to the damper shaft 15 in a manner similar to that employed on a conventional type damper 16. When so secured, the damper 16 and the handle of the damper shaft 15 are aligned in the same plane.

The damper 16 is then placed in an open position such that the plane of the damper 16 lies along the axis of the stovepipe 1. The yoke 7 is rotated about the damper shaft 15 until the knurled wheel 8 engages in the latch 5. When this condition is achieved, the set screw 19 on the set collar 18 is tightened securing the yoke 7 to the damper shaft 15.

The safety stovepipe damper is preset by rotating the yoke 7 to a position which in the judgement of the stove operator is a safe low fire or normal dampered position. When the desired dampered position is obtained, the bead chain 9 is pulled tight and inserted into the notch 12 on the clip 11. When the operator tends a coal, wood, or waste burning stove, it is common practice to first open the damper 16 to prevent smoke entering the room. Opening the safety stovepipe damper results in a latching of the knurled wheel 8 with the latch 5. If the damper 16 should be forgotten in an open position the stove and the stovepipe 1 will soon overheat. Heat radiating from the stovepipe 1 heats the bi-metal strip 14, resulting in rotation of the knurled wheel 8. The friction of the knurled wheel 8 rotating against the latch 5 causes it to raise, releasing yoke 7. The yoke 7 is thus released to fall by gravity to the preset position limited by the length of the bead chain 9.

While the above description contains numerous specificities, these should not be construed as limitations on the scope of the invention, but rather as an exemplification of one preferred embodiment thereof. Many other variations are possible; for example, the bead chain 9 could be replaced with an adjustable stop located on the side plate 4, or by use of a rigid rod with sliding and locking set collar. Another variation may utilize an expanding or lengthening shaft 13 which would release engagement of the latch 5 upon being subjected to radiant heat from the stovepipe 1. Still another variation may utilize an abrasive covered wheel 8 to replace the knurled wheel 8 on the yoke 7.

Accordingly, the scope of the invention should be determined not by the embodiment illustrated, but by the appended claims and their legal equivalents. It is to be understood that it may well be that modifications and improvements may be made in this invention by those skilled in the art without departing from the spirit and scope thereof.

It is also to be understood that while the invention has been described in terms of certain particular structures, methods, and arrangements, the invention is not to be limited to these structures, methods, or arrangements except insofar as they specifically set forth in the subjoined claims.

The embodiments of the invention in which an exclusive property or privilege is claimed are defined as follows:

1. A thermally responsive safety stovepipe damper assembly adapted for mounting in a natural draft combustion unit flue, said damper assembly comprising a generally cylindrical duct for mounting in communication with said flue, said flue having a pair of diametrically opposed aperatures therein, a side plate including means affixing said side plate to said flue, said side plate having an aperature disposed in co-axial alignment with said flue aperatures, a slotted clip including means affixing said clip to said plate, a latch including means for pivotally mounting to said side plate, said side plate including stop means for said latch, said flue having a damper plate with a generally circular periphery of diameter somewhat less than the inside diameter of said flue, a damper shaft extending through said flue aperatures and said side plate aperature in rotational relation therein, said damper shaft including means engagable with said damper plate for non-rotatable relation therein, a yoke having a base with extending legs, said legs having aperatures therein in co-axial alignment, said damper shaft extending through said yoke leg aperatures, a bushing having a bore, said bushing affixed outboard of one said yoke leg in co-axail alignment with said aperature therein, said bushing receiving said damper shaft, means securing said bushing to said damper shaft in fixed relation thereto, said bushing diametrically opposite said side plate, said damper shaft having a handle at one end, a helical compression spring receiving said damper shaft and co-acting between said handle and said yoke leg, said spring means insuring said means engagable between said damper plate and said damper shaft, a pair of aperatures disposed at said yoke base in co-axial alignment parallel to the axis of said damper shaft, a shaft extending through said aperatures in rotational relation thereto, a knurled wheel affixed to one projecting end of said shaft, means engagable with said latch, a helically shaped bimetal strip in co-axial alignment with said shaft, said bimetal strip affixed at one end to said yoke base and at other end to said shaft, said bimetal strip being responsive to changes in temperature of said flue to rotate said wheel for disengagement of said latch, a bead chain pivotally secured at one end to said yoke leg, said chain engaged in said clip slot for predetermined travel limit of said yoke for closing of said damper plate, said yoke base having housing means to enclose said bimetal strip against said flue when said damper plate is in an open position, said flue having a heat shield including means affixing to said flue, said heat shield reducing thermal radiation from said flue to said bimetal strip when said damper plate is in a closed position.

2. An arrangement as described in claim 1 wherein: said damper shaft including means engagable with said damper plate for non-rotatable relation therein includes means fixidly securing said damper shaft to said damper plate.

3. An arrangement as described in claim 1 wherein: said means engagable with said latch includes frictional means.

4. An arrangement as described in claim 1 wherein: said means engagable with said latch includes mechanical means.

5. An arrangement as described in claim 1 wherein: said bead chain includes means connecting said yoke to said clip in adjustable relation therewith.

6. An arrangement as described in claim 1 wherein: said heat shield includes means of reducing thermal radiation between said flue and said bimetal strip.

7. An arrangement as described in claim 1 wherein: said heat shield is not included.

* * * * *